US006309210B1

(12) United States Patent
Marin et al.

(10) Patent No.: US 6,309,210 B1
(45) **Date of Patent: *Oct. 30, 2001**

(54) KILN UNIVERSAL OXYGEN ENRICHMENT

(75) Inventors: Ovidiu Marin, Lisle; Mahendra L. Joshi, Darian; Olivier Charon, Chicago, all of IL (US); Jacques Dugue, Montigny le Bretonneux (FR)

(73) Assignee: L'Air Liquide, Societe Anonyme pour l'etude et, l'Exploitation des Procedes Georges Claude, Paris Cedex (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/268,668

(22) Filed: Mar. 16, 1999

(51) Int. Cl.[7] ..... F27B 15/00
(52) U.S. Cl. ..... 432/14; 432/78; 432/106
(58) Field of Search ..... 432/106, 77, 78, 432/79, 85, 58, 15, 14

(56) References Cited

U.S. PATENT DOCUMENTS

| | | | | |
|---|---|---|---|---|
| 3,276,755 | * | 10/1966 | Bast | 432/78 |
| 3,397,256 | | 8/1968 | Paul et al. . | |
| 3,469,828 | * | 9/1969 | Lane | 432/77 |
| 3,955,995 | * | 5/1976 | Touborg | 106/100 |
| 4,248,639 | * | 2/1981 | Quittkat | 106/759 |
| 4,280,418 | * | 7/1981 | Erhard | 110/347 |
| 4,289,483 | * | 9/1981 | Deussner | 432/106 |
| 4,295,823 | * | 10/1981 | Ogawa et al. | 432/106 |
| 4,354,829 | | 10/1982 | Estes . | |
| 4,367,065 | * | 1/1983 | Cnare | 432/14 |
| 4,457,705 | * | 7/1984 | Ramesohl et al. | 432/106 |
| 4,708,644 | * | 11/1987 | Lawall et al. | 432/106 |
| 4,741,694 | | 5/1988 | Mason et al. . | |
| 4,774,064 | * | 9/1988 | Arnold et al. | 423/168 |
| 4,922,841 | * | 5/1990 | Kent | 110/346 |
| 4,934,931 | * | 6/1990 | Angelo, II | 432/105 |
| 5,007,823 | | 4/1991 | Mayotte et al. . | |
| 5,454,714 | * | 10/1995 | Paliard | 432/14 |
| 5,572,938 | | 11/1996 | Leger . | |
| 5,580,237 | | 12/1996 | Leger . | |
| 5,882,190 | * | 3/1999 | Doumet | 432/106 |
| 5,927,967 | * | 7/1999 | Bauer et al. | 432/72 |

OTHER PUBLICATIONS

Gaydas, R.A., "Oxygen Enrichment of Combustion Air in Rotary Kilns," Journal of the PCA R & D Laboratories, 49–66 (Sep. 1965).

Wrampe, P. and Rolseth, H.C., "The effect of oxygen upon the rotary kiln's production and fuel efficiency: theory and practice," IEEE Trans. Ind. App., 568–573 (Nov. 1976).

* cited by examiner

*Primary Examiner*—Jiping Lu

(57) ABSTRACT

A kiln is provided with oxidant injection locations upstream of air blowers which blow air into the kiln. The addition of oxygen into the kiln increases the cooling capacity of a clinker cooler, and enhances combustion in the kiln.

20 Claims, 4 Drawing Sheets

KILN UNIVERSAL OXYGEN ENRICHMENT

BACKGROUND OF THE INVENTION

1. Field of the Invention

The present invention relates to novel apparatus and processes for the injection of oxygen into a rotary kiln. More particularly, the present invention relates to apparatus and processes which significantly improve combustion in a rotary kiln used for the calcination of minerals such as cement, lime, dolomite, magnesia, titanium dioxide, and other calcined materials 2. Brief Description of the Related Art In recent years, demand for cement and other calcined materials has outstripped production. In the construction industry, delays to building and transportation improvement projects have been caused by lack of sufficient cement.

The introduction of oxygen into a combustion space, e.g., a furnace, is used in a variety of industries for enhancement of the combustion process. To date, the use of oxygen in rotary kilns has been applied in three main ways, well documented in the literature: introducing oxygen into the primary air, i.e., into the main burner; the utilization of an oxy-fuel bumer in addition to a standard air-fuel burner; and oxygen lancing into the rotary kiln, particularly in a region between the load and the flame, for improved flame characteristics. One of the more documented uses of oxygen in rotary kilns is described in Wrampe, P. and Rolseth, H. C., "The effect of oxygen upon the rotary kiln's production and fuel efficiency: theory and practice", IEEE Trans. Ind. App., 568–573 (November 1976) (incorporated by reference in its entirety herein), which indicates that production increases above 50% produce excessive temperatures into the kiln, but, below this level, kiln operation takes place without major problems.

Each method of introducing oxygen into the cement plant has its advantages, as well as disadvantages. Thus, the introduction of oxygen into the primary air limits the total amount of oxygen capable of being introduced into the kiln, as modern cement kilns utilize 5–10% of the total air used as primary air. Therefore, in order to introduce a meaningful amount of oxygen into the kiln, it is necessary to significantly increase the concentration of oxygen in the air-fuel stream. Increases in the oxygen concentration leads to potential safety problems, since the fuel is in contact with the $O_2$ enriched air prior to its arrival into the kiln's combustion space, and therefore can burm too early, and or even result in explosions.

The use of a separate oxy-burner represents a more involved solution to increase the thermal transfer to the load, which in general requires significant quantities of quality fuel, such as natural gas or oil, as well as important modifications in the kiln back wall. This method has been previously proposed, such as U.S. Pat. No. 3,397,256 (which is incorporated by reference in its entirety herein). The use of oxygen lances, although a more elegant solution, can locally increase the temperature of the combustion space, which can result in nonuniform heat transfer to the entire flow of clinkers moving through the kiln. Lancing can also produce hot spots in the refractory, which can potentially damage the refractory. The introduction of cold oxygen can lastly limit the beneficial effect of oxygen on combustion, by locally cooling the flame. The employment of lances has been proposed in U.S. Pat. No. 5,572,938, U.S. Pat. No. 5,007,823, U.S. Pat. No. 5,580,237, and U.S. Pat. No. 4,741,694, all of which are incorporated by reference in their entireties herein.

U.S. Pat. No. 4,354,829 describes mixing air and oxygen in a separate pipe, and introducing it through the rotary kiln moving walls. This device suffers from a number of significant problems, which include: the difficulty of creating a leak-free plenum which rotates with the kiln; the difficulty of installing tubes into the kiln; the fact that the air-oxygen mixture is introduced in a location which might actually hurt the combustion process; and the fact that the air introduced in the rotary kiln is cold, therefore introducing additional stresses in the rotary kiln which can damage its very expensive structure from thermal shock.

The general use of oxygen in cement rotary kilns has already been documented to lead to a significant production increase of the kiln, starting with the work of Gaydas, R. A., "Oxygen enrichment of combustion air in rotary kilns," Journal of the PCA R & D Laboratories, 49–66 (September 1965) (incorporated by reference in its entirety herein). Gayclas presents test results from a period between 1960 and 1962. It is mentioned that Geissler suggested in 1903 that oxygen be used for clinker production. Experimental work was done in Germany in the 1940's, but results are not available. If not specifically addressed, a production increase can create various bottleneck regions, such as in clinker cooling equipment or the flue gas exhaust system.

It is one object of the present invention to provide a way of improving the clinker cooler performance in a rotary kiln.

It is another object of the present invention to provide a safe, yet efficient system and method of introducing oxygen into rotary kilns used, for example, in cement producing equipment, in a manner which will enhance flame characteristics and improve production without adversely effecting overall plant operation.

SUMMARY OF THE INVENTION

According to a first exemplary embodiment, an improved kiln useful in producing clinkers comprises a kiln chamber having an inlet and a clinker outlet, a burner positioned so that its flame is directed into said kiln chamber, said burner including a fuel inlet, an oxidant inlet, and an outlet, a clinker cooler positioned to receive clinkers from said clinker outlet and including at least one air inlet into said clinker cooler, and an oxidant source in fluid communication with an inlet of said kiln selected from the group consisting of said burner oxidant inlet, said clinker cooler air inlet, and both.

According to a second exemplary embodiment, a process of operating a kiln comprises the steps of providing a kiln including a kiln chamber, an inlet, and a clinker outlet, a burner positioned so that its flame is directed into said kiln chamber, said burner including a fuel inlet, an oxidant inlet, and an outlet, a clinker cooler positioned to receive clinkers from said clinker outlet and including at least one air inlet into said clinker cooler, and an oxidant source in fluid communication with an oxidant inlet of said cement kiln selected from the group consisting of said bumer oxidant inlet, said clinker cooler air inlet, and both, flowing oxidant from said oxidant source through said cement kiln oxidant inlet, and flowing material to be calcined into the kiln chamber to form clinkers.

Still other objects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to preferred embodiments of the apparatus and method, given only by way of example, and with reference to the accompanying drawings, in which.

DESCRIPTION OF THE PREFERRED EMBODIMENTS

Figure 1:
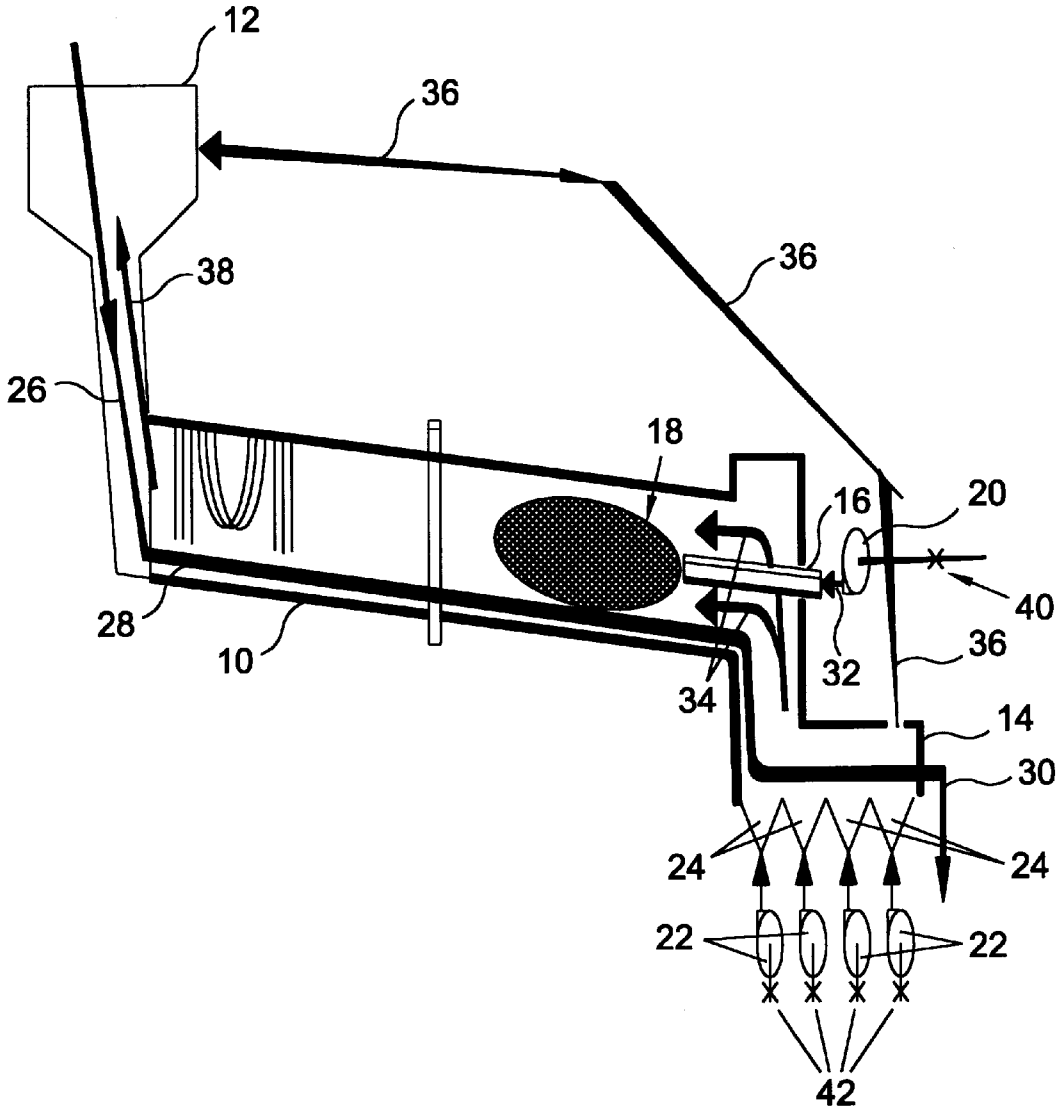
FIG. 1 is a schematic illustration of a rotary kiln in accordance with a first embodiment of the present invention.

Referring to the drawing figures, like reference numerals designate identical or corresponding elements throughout the several figures.

One major problem encountered by the cement industry has been finding systems and processes to efficiently boost production, while still using the existing production facilities. As discussed above, it has been documented that the introduction of additional oxygen into a clinker kiln can lead, among other improvements, to important production increases. Oxygen injection can also lead to enhanced combustion, increased dust insufflation, and other improvements over kilns which do not utilize oxygen injection. The present invention utilizes additional oxygen introduction, and more generally oxygen-containing gas, in cement plants in such a way as to capitalize on these advantages. Furthermore, the present invention addresses related issues raised by increasing production, such as the occurrence of bottleneck locations throughout the system, flue gas limitations, clinker cooler limitations, and clinker transport out of the plant.

The introduction of oxygen in accordance with the present invention allows a reduction in flue gas volume, as well as increased heat transfer to the load and therefore increased production. The presence of nitrogen in air introduced into the kiln requires energy for heating the entire gas mass to high temperatures, without aiding the clinker formation process. The introduction of additional oxygen in pure or substantially pure form reduces the proportion of nitrogen in the flue gases, thus increasing the amount of high grade heat, considered to be heat above a certain temperature, available to the kiln.

Traditionally, oxygen had been directly introduced at ambient (atmospheric) temperature into the cement plant in the vicinity of the combustion space. An increase in kiln production from oxygen introduction can result in a reduction in available combustion air, which reduces the cooling capacity of the clinker cooler, thus causing the clinker to exit the cement plant too hot. The present invention reduces this negative effect, by increasing the total gas flow rate through the clinker cooler, through the addition of a significant amount of oxygen to the existing amount of air prior to the clinker cooler. Thus the present invention increases the thermal efficiency of the cement plant by not only additionally cooling the clinker, but also by increasing the temperature of the injected oxygen to values between about 400° C. and about 900° C. Depending on the amount of oxygen used, the present invention can recuperate an additional 1–2 megawatt (MW) heat flux into the cement plant.

For example, and not by way of limitation, if the total additional oxygen injection into the kiln is about 150 tons per day (t/d), in order to increase the temperature of the oxygen from ambient to about 900° C., the power received by the oxygen and reintroduced into the kiln is approximately 1.4 MW. This oxygen consumption increases the oxygen concentration in the oxidant to about 23% for a mid-sized cement kiln, which is well within the accepted oxygen enrichment levels. Systems in accordance with the present invention also aid the combustion process, allowing the fuel to more rapidly ignite and combust, because the hot oxidant mixes with the fuel. Rapid ignition not only enhances the combustion process, with positive effects on emissions, but also allows more dust to be insufflated into the kiln, which further increases production. This is because enhanced combustion from the use of hot oxygen or oxygen-enriched gas counteracts the inhibitory effects of dust on the combustion process.

Prior systems and processes do not recognize the benefits of heated oxygen injection in the cement plant. Similarly, universal or system-wide oxygen enrichment of cement plants has not been identified in the prior art.

A process in accordance with the present invention is an enhancement of cement manufacturing technology. The present invention includes methods of enriching the air necessary for combustion purposes with oxygen, in order to increase the heat transferred to the clinker. The oxygen enrichment is used for increasing the plant production and reducing the risk of bottlenecking the cement production in various places, such as the clinker cooler. According to exemplary embodiments of the present invention, a process injects an amount of oxygen prior to (upstream) or after (downstream) the fans or blowers carrying the air used for combustion purposes in the cement plant, but before the clinker cooler. Thus, the oxygen is well mixed with the air before the clinker cooler, Icading to an increase in the cooling capacity of the cooler, as well as to enhanced heat recovery as the clinkers transfer heat to the oxygen-enriched air which flows into the kiln. In addition to these advantages, the heated oxygen leads to improved combustion in the plant, particularly in the kiln. Improved combustion which is achieved with the present invention is particularly beneficial in cement plants with dust recycling systems, as the enhanced combustion allows a larger amount of dust to be recirculated through the kiln without an adverse effect on burner performance and kiln temperatures.

Turning now to the drawing figures, FIG. I illustrates portions of a cement plant in accordance with a first exemplary embodiment of the present invention. A kiln 10, e.g., a rotary kiln, is used to heat and to prepare the clinker (not illustrated). After the clinker formation is completed in kiln 10, it exits the kiln and goes through a clinker cooler 14 where it is cooled to a prescribed and predetermined temperature. Combustion air (secondary and/or tertiary air) is used to cool the clinker; therefore, a significant part of the combustion air recuperates the heat provided by the clinker.

Kiln 10 includes a burner 16 which extends into the interior of the kiln in a fashion which will be readily apparent to one of ordinary skill in the art. Burner 16 supplies heat, via a combustion zone 18, necessary to increase the temperature of the raw material (not illustrated) which moves through the kiln, as well as enabling the various chemical reactions which transform the raw material into clinker. In more modern cement plants, a very significant amount of energy is provided to the raw material prior to its arrival in kiln 10. These plants are equipped with a (pre)calciner 12, where up to about 60% or more of the total heat is provided to the raw material through combustion. The air required for combustion is thus generally split into several different streams into the cement plant.

An optional primary fan or blower 20 supplies air to burner 16 along a primary air path 32, the primary air preferably being used to transport fuel into kiln 10. The amount of primary air preferably varies between about 4% and about 50% of the total air that enters the kiln, with modern cement plants typically being supplied with a reduced amount of primary air. Secondary fans or blowers 22 supply secondary air via air inlets 24 to clinker cooler 14, to cool the hot clinkers as they exit kiln 10. Correspondingly, the air used to cool the clinkers in clinker cooler 14 is heated to a temperature typically between about 600° C. and about 900° C. Thus, the clinkers transfer heat to the secondary air, which flows along a secondary air path 34 into kiln 10. The preheated secondary air therefore aids in clinker production, both by providing an additional source of oxidant to the kiln, and by not acting as a thermal sink to the kiln. Increasing production requires an increased amount of air through clinker cooler 14, as well as resulting in an increased flow rate of clinker through the clinker cooler.

As described above, the cement plant may optionally, and preferably, be provided with (pre) calciner 12. Thus, raw material enters the system through (pre) calciner 12 along raw material flow path 26, and is preheated and processed therein. The material then flows along a kiln flow path 28 through kiln 10, where the material is sufficiently heated to produce clinkers. The clinkers then exit kiln 10 into clinker cooler 14 along clinker flow path 30, where the clinkers are cooled to a predetermined temperature, and then exit the clinker cooler. While a portion of the secondary air provided by blowers 22 flows along secondary air path 34, a portion is diverted out of clinker cooler 14 along a tertiary air path 36 which leads to (pre) calciner 12, which enhances the calcination processes on the raw material therein and prior to entering kiln 10. Flue gas exits kiln 10 along a flue gas flow path 38 which, in the embodiment illustrated in FIG. 1, directs flue gases into (pre) calciner 12. As will be readily appreciated by one of ordinary skill in the art, the flue gases can further enhance the calcinization processes perfoimed in (pre) calciner 12, because of the additional heat transfer from the flue gases to the raw material.

In accordance with the present invention, additional oxygen or oxygen-containing gas, e.g., oxygen-enriched air, is injected into pre-combustion air to achieve the benefits described above. In the context of the present invention, reference to the injection of oxygen includes the injection of pure oxygen, oxygen-containing gas, and/or oxygen-enriched air, as well as other oxidants. In the embodiment illustrated in FIG. 1, oxygen is injected at one or both of two locations in the system: at a primary oxygen injection location 40, upstream of primary air blower 20; and at secondary oxygen injection locations 42, upstream of one or more of secondary air blowers 22.

As discussed above, injection of oxygen into the primary air provides an enhancement of, among other things, the ability of kiln 10 and burner 16 to recycle dust which is insufflated into the kiln, without degradation of the burn and temperature drops in the kiln. Additionally, the introduction of heated oxygen into the kiln leads to a reduced flame length, as well as to a more stable flame. Furthermore, injection of oxygen into the secondary air provides yet another source of oxidant for burner 16, preheats this oxidant prior to admission into kiln 10, and enhances the cooling capacity of clinker cooler 14. Additionally, injection of oxygen into the secondary air can produce further production benefits, because a portion of the secondary air flows along tertiary flow path 36 to (pre) calciner 12, wherein the (pre) calcinization process is enhanced by the introduction of oxidant-enriched, preheated air.

Figure 2:
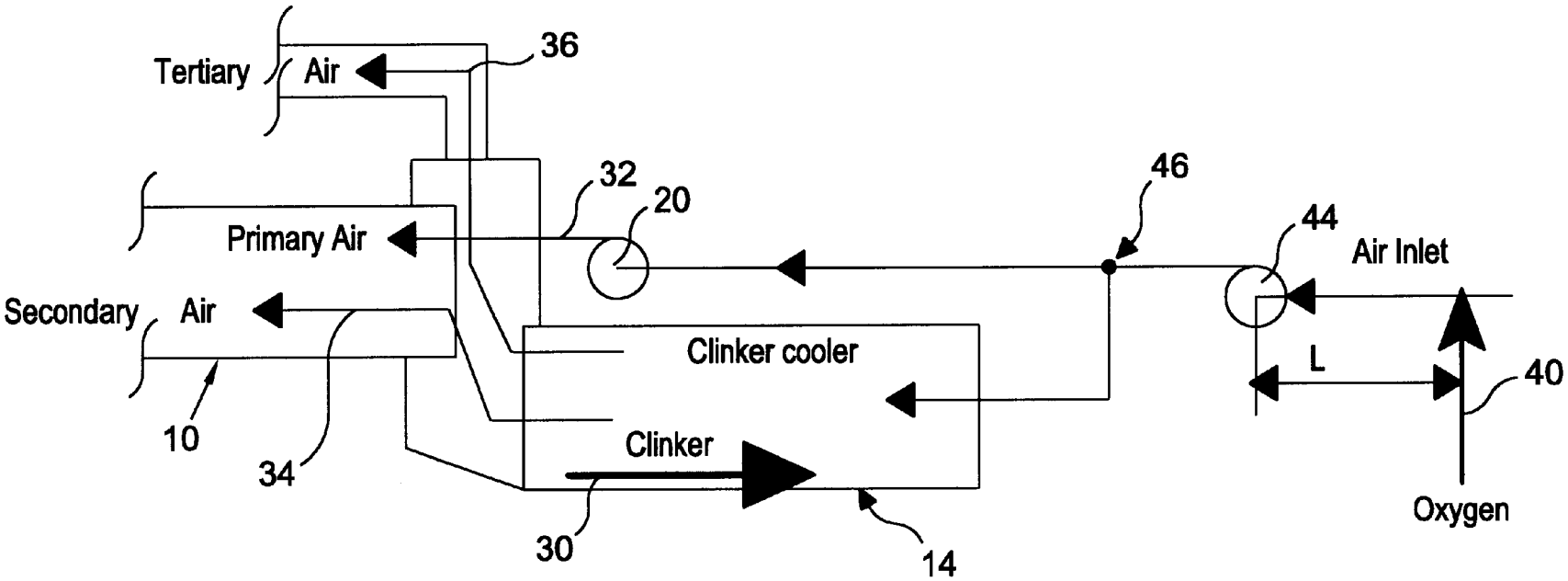
FIG. 2 is a schematic illustration of a rotary kiln in accordance with a second embodiment of the present invention.

FIG. 2 illustrates portions of a cement plant in accordance with a second exemplary embodiment of the present invention. In the embodiment illustrated in FIG. 2, oxygen injection location 40 is provided upstream of a second, primary air blower 44 at a distance L. Distance L, as well as the injector diameter and detailed injector geometry, is selected so that the air and oxygen that are drawn in to second blower 44 have a sufficient opportunity to mix so that there are no small, local pockets of oxygen in the air which is drawn into second blower 44. Distance L is equally applicable to the other blowers described herein, including blowers 20 and 22.

From second blower 44, the oxidant-enriched air flows to a junction point 46, where the flow splits into clinker cooler 14 and blower 20 (if provided). The split of oxidant-enriched air at point 46 can be regulated by mechanisms well appreciated in the art, both manual and automated, and the mass flows can vary according to the needs in the kiln. Clinker cooler 14, in the embodiment illustrated in FIG. 2, may be a tube cooler or a rotary cooler.

The embodiment illustrated in FIG. 2 is preferable when it is desirable to convey the entire mass of oxygen-enriched air into the cement plant through a single piping system. That is, the piping system can be common for the entire oxygenenriched requirements of the plant, such as for the primary air going into the main bumer, the secondary air going into the clinker cooler and then to the kiln, and the tertiary air going into the clinker cooler and then into the (pre) calciner. Furthermore, the embodiment illustrated in FIG. 2 has the advantage of ensuring proper mixing of the air and oxygen, given the extended length between the oxygen injection location and the air inlet into the kiln. It also requires only one mixing section of the pipe, reducing the cost associated with the use of multiple injectors and mixing ducts (which can be fairly long, depending on the amount of oxygen injected).

Figure 3:
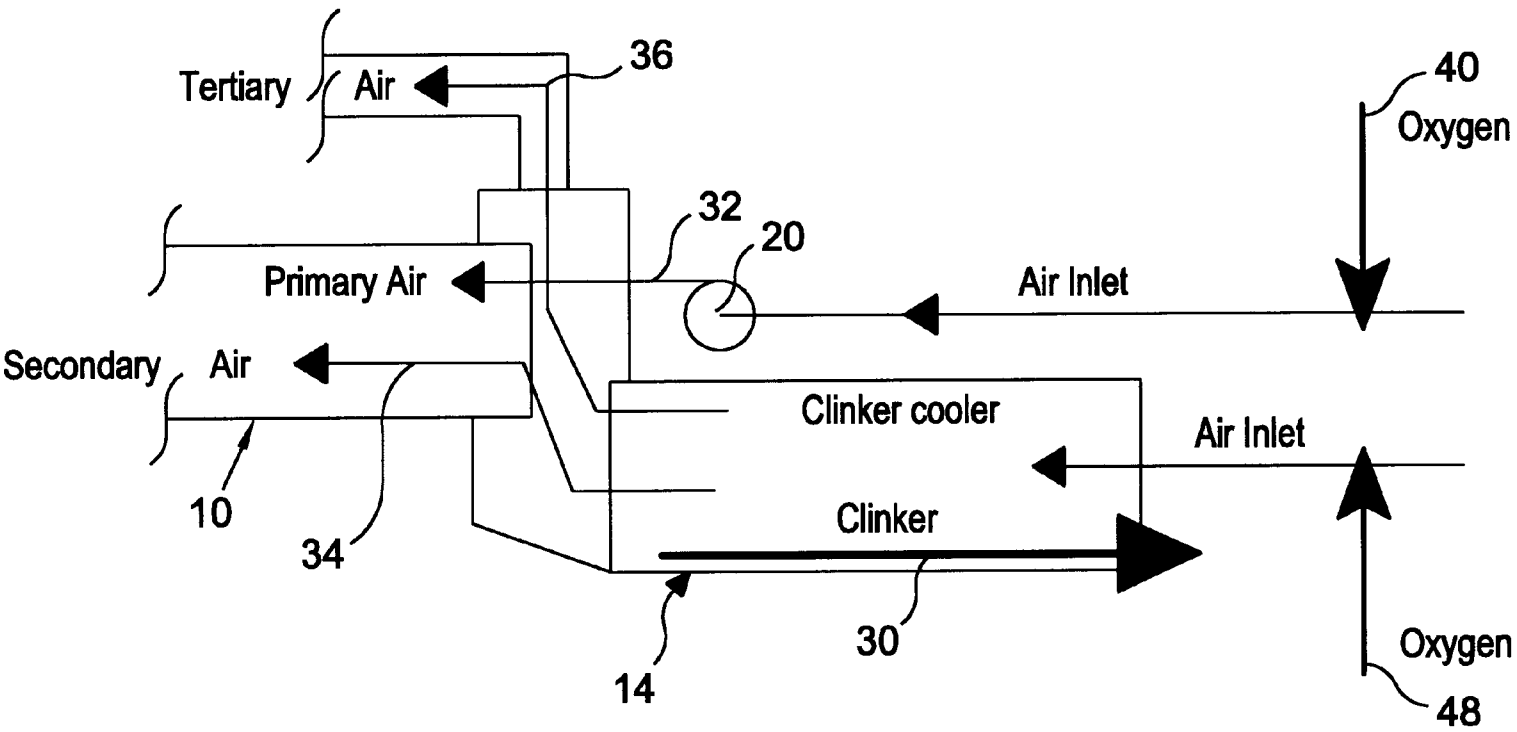
FIG. 3 is a schematic illustration of a rotary kiln in accordance with a third embodiment of the present invention.

FIG. 3 illustrates portions of a cement plant in accordance with a third exemplary embodiment of the present invention. In the embodiment illustrated in FIG. 3, oxygen injection location 40 is similar to the embodiment illustrated in FIG. 1. A separate oxygen injection location 48 is provided for the air entering clinker cooler 14 and prior to the air blowers. The embodiment illustrated in FIG. 3 is extremely simple to implement, because it does not require additional modifications of an existing cement plant's air piping. In turn, the embodiment illustrated in FIG. 3 requires a more involved oxygen injection scheme, including at least two oxygen injectors and piping from the oxygen storage facility (not illustrated) upstream of oxygen injection locations 40, 48.

Figure 4:
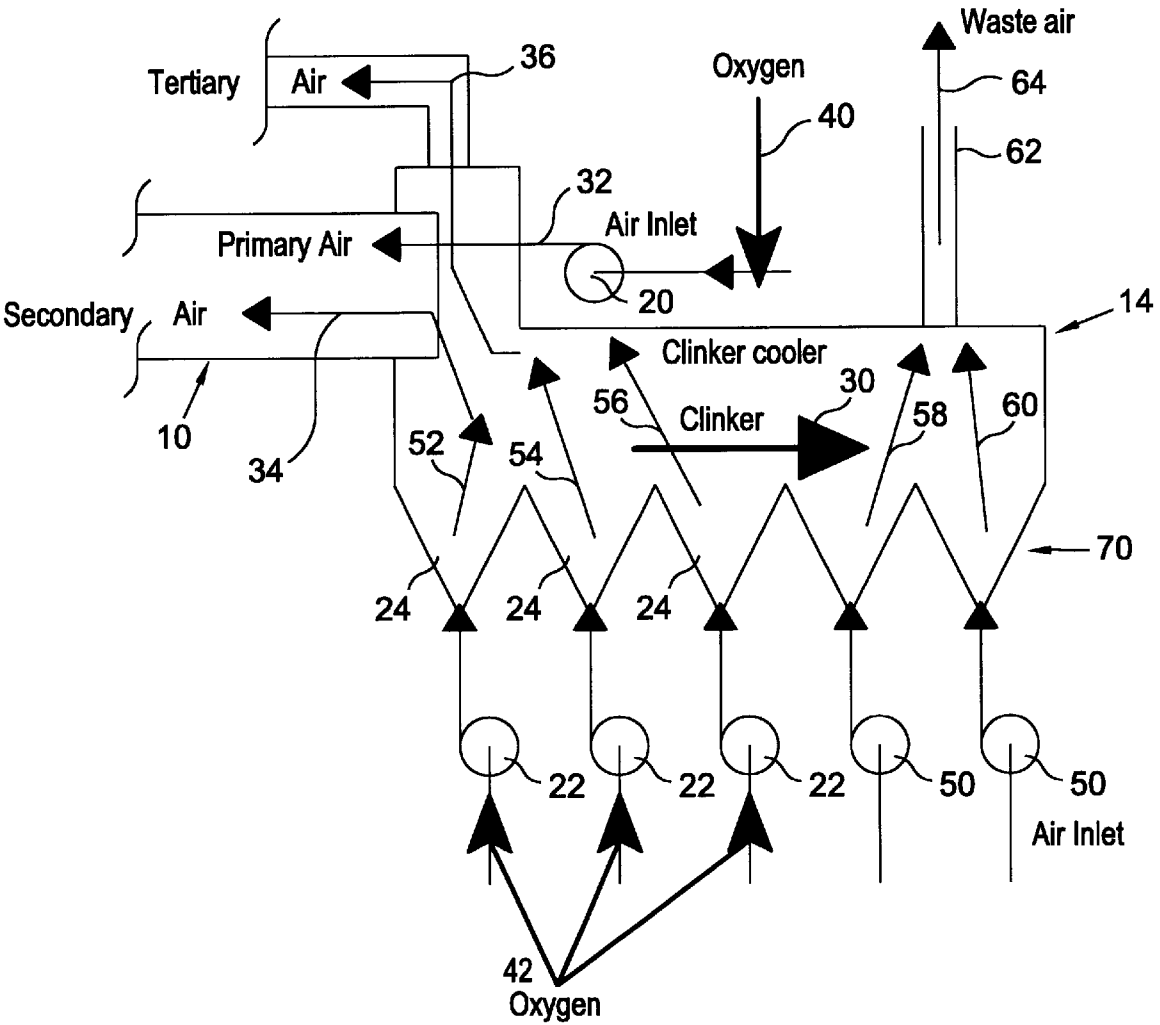
FIG. 4 is a schematic illustration of a rotary kiln in accordance with a fourth embodiment of the present invention.

FIG. 4 illustrates portions of a cement plant in accordance with a fourth exemplary embodiment of the present invention. In the embodiment illustrated in FIG. 4, a cement plant includes a grate cooler 70 in clinker cooler 14, which includes a plurality of air inlets 24 and secondary air blowers 22. In prior cement plants including grate coolers, a portion of the secondary air used to cool tile clinker is used as secondary or tertiary air, as described above with reference to FIG. 1, while the remainder of the heated air is waste air which flows along a waste air flow path 64 through a waste stack 62 , and is then released into the atmosphere. This leads to significant heat losses and to an overall thermodynamic efficiency reduction in the cement plant.

FIG. 4 illustrates portions of a cement plant which includes a grate cooler 70, with a plurality of air inlets 24 into the grate cooler. According to the embodiment illustrated in FIG. 4, however, oxygen is injected only upstream of blowers 22, while blowers 50 do not supply oxygen-enriched air to grate cooler 70. Because of the geometry of grate cooler 70, blowers 22 generate air stream 52, which primarily leads to secondary air path 34, and air streams 54, 56, which primarily lead to tertiary air flow path 36. Of course, some cross-flow can be expected. Blowers 50, however, primarily generate air streams 58, 60, which, after cooling clinkers that move along clinker flow path 30, exit clinker cooler 14 though waste stack 62 along waste air flow path 64. Thus, oxygen injected into clinker cooler 14 is not wasted, the enhanced cooling capacity of the oxygen-enriched air flowing along air streams 52, 54, and 56 allows less air to be blown by blowers 50 and exhausted from the plant, and the cement plant benefits from the recovered energy in the preheated secondary and tertiary, oxygen-enriched air.

With reference to FIGS. 1–4, exemplary processes in accordance with the present invention will now be described. Raw material is caused to move along raw material flow path 26, and optionally through (pre) calciner 12. When (pre) calciner 12 is provided, the raw material is heated and partially processed therein. The material then moves into kiln 10, is burned and calcined to form clinkers, and exits the kiln into clinker cooler 14. During the calcinization processing in kiln 10, air is blown by blowers 20 (if provided), 22, 44, and 50 into the system, and oxidant is injected into the air before entering the system's blowers at injection locations 40, 42, and 48, to form oxidant-enriched air. With reference to FIG. 2, the oxidant-enriched air can be then split between the burner oxidant inlet and the clinker cooler oxidant inlet. Oxidant-enriched air which is blown into the clinker cooler then cools the hot clinkers from the kiln, and the hot clinkers transfer heat to the oxidant-enriched air in the clinker cooler to produce preheated, oxidant-enriched air. This preheated oxidantenriched air is then allowed or cause to flow into the kiln chamber as secondary, preheated, oxidant-enriched air, and if a precalciner is provided, a portion of the preheated oxidant-enriched air is allowed or caused to flow downstream to the precalciner. With reference to FIG. 4, additional air is blown into the grate cooler, but is not enriched with additional oxygen, and is allowed or caused to primarily flow out of the clinker cooler out of waste stack 62, while preheated oxidant-enriched air from inlets 24 is allowed or caused to primarily flow into the kiln chamber and (pre) calciner 12.

Thus, systems and processes in accordance with the present invention include devices and steps in which oxygen is injected into all the air flow streams into the cement plant which are designated for combustion/transport purposes, or selectively, to certain flows of air into the cement plant, including selected or all air flow streams passing through the clinker cooler. The oxygen injection locations are preferably prior to, or after, the blowers designed to carry the air into the cement plant. If the injection is prior to the fans, the required oxygen pressure is relatively low, while the mixing between the air and oxygen can be efficiently performed. In conditions of high pressure oxygen availability, the injection can be performed after the fans, which eliminates a potential safety concern regarding oxygen passage through the fans. In the present invention, oxygen injection is used to obtain an increased thermal load to the clinker, in conditions which are operationally safe, and to increase the overall cement plant efficiency. Additionally, the present invention can result in an increase in clinker production. Oxygen enrichment according to the present invention may therefore include the entire mass of air introduced into the cement plant for combustion purposes, or selectively into at least one of the air inlets into the clinker cooler.

The invention is therefore also directed to a process of universal enrichment with oxygen of the air introduced in the cement plant for combustion purposes. The injection process includes at least one oxygen injector in a specially designed piping system before or after the blowers carrying combustion air into the cement plant. When injected before the blowers, oxygen enrichment according to the present invention can be performed with relatively low pressure oxygen, given the relatively low pressure of the air flow upstream of the blower.

The present invention can result in improved combustion process in a cement plant, resulting in, among other advantages, increased clinker production. Heat and mass balance calculations performed on an actual cement plant geometry and parameters have shown that the introduction of oxygen upstream of the blowers increases clinker production by about 2.5 tons clinker/ton of oxygen introduced in the kiln, for the levels of global enrichment of between about 21.5% and about 28% oxygen, preferably about 23% oxygen, in the oxidizer mixture.

The introduction of the hot, oxygen-enriched air in accordance with the present invention increases the thermal efficiency of the cement plant, leading to lower clinker temperature, and therefore to lower heat lost with the clinker, the balance in this heat being re-introduced, recycled, or recuperated in the cement plant with the heated oxygen. Heat and mass balance calculations perfomed on an actual cement plant geometry and parameters have shown that the introduction of oxygen prior to the blowers has increased the efficiency of the plant by to up to 10% when compared to the introduction of the same amount of oxygen through conventional methods, described above.

While the invention has been described in detail with reference to preferred embodiments thereof, it will be apparent to one skilled in the art that various changes can be made, and equivalents employed, without departing from the scope of the invention.

What is claimed is:

1. A process of operating a kiln, comprising the steps of:

providing a kiln including a kiln chamber, an inlet, and a clinker outlet, a burner positioned so that its flame is directed into said kiln chamber, said burner including a fuel inlet, an oxidant inlet, and an outlet, a clinker cooler positioned to receive clinkers from said clinker outlet and including at least one air inlet into said clinker cooler, and an oxidant source in fluid communication with said at least one clinker cooler air inlet;

wherein said oxidant source comprises a non-pure-air oxidant selected from the group consisting of pure oxygen and oxygen-enriched air;

flowing oxidant from said oxidant source through said at least one clinker cooler air inlet; and flowing material to be calcined into said kiln chamber to form clinkers.

2. A process of operating a kiln in accordance with claim 1, wherein said providing step further comprises the step of providing a kiln including a precalciner including a raw material inlet, a precalcined material outlet, and an air inlet, wherein said precalciner precalcined material outlet leads to said kiln chamber inlet, wherein said precalciner air inlet is in fluid communication with and downstream of said clinker cooler, and wherein said flowing step further comprises flowing oxidant to said clinker cooler air inlet to form oxidant-enriched air in said clinker cooler, said precalciner producing precalcined material which then becomes material to be calcined.

3. A process of operating a kiln in accordance with claim 2, wherein said flowing step further comprises the step of flowing oxidant-enriched air from said clinker cooler to said precalciner air inlet.

4. A process of operating a kiln in accordance with claim 1, further comprising the steps of:

heating said material to be calcined in said kiln to form a hot clinker;

moving said hot clinker to said clinker cooler;

transferring heat from said hot clinker to air blowin, into said clinker cooling from said at least one clinker cooler air inlet, to produce a cooled clinker and preheated air.

5. A process of operating a kiln in accordance with claim 4, wherein said flowing step further comprises flowing oxidant to said clinker cooler air inlet and into said preheated air to produce oxidant-enriched, preheated air, and further comprising the step of flowing said oxidant-enriched, preheated air into said kiln chamber.

6. A process of operating a kiln in accordance with claim 5, wherein said providing step further comprises the step of providing a kiln including a precalciner including a raw material inlet, a precalcined material outlet, and an air inlet, wherein said precalciner precalcined material outlet leads to said kiln chamber inlet, wherein said precalciner air inlet is in fluid communication with and downstream of said clinker cooler.

7. A process of operating a kiln in accordance with claim 6, wherein said flowing step further comprises the step of flowing said oxidant-enriched, preheated air from said clinker cooler to said precalciner air inlet.

8. A process of operating a kiln in accordance with claim 1, wherein said flowing step comprises flowing oxidant from said oxidant source through said burner oxidant inlet.

9. A process of operating a kiln in accordance with claim 1, wherein said flowing step comprises the steps of:

premixing oxidant and air to form a flow of oxidant-enriched air; and splitting said flow of oxidant-enriched air to both said bulner oxidant inlet and said clinker cooler air inlet.

10. A process of operating a kiln in accordance with claim 1, wherein said providing step further comprises providing a grate cooler in said clinker cooler, said grate cooler including at least two air inlets, and a waste air outlet, and further comprising the step of flowing oxidant through fewer than all of said grate cooler air inlets.

11. A process of operating a kiln in accordance with claim 10, further comprising flowing air into said clinker cooler through one of said at least two air inlets through which no oxidant is caused to flow.

12. A process of operating a kiln in accordance with claim 1, wherein said step of providing a kiln comprises providing a rotary kiln.

13. An improved kiln useful in producing clinkers, comprising:

a kiln chamber having an inlet and a clinker outlet;

a burner positioned so that its flame is directed into said kiln chamber, said burner including a fuel inlet, an oxidant inlet, and an outlet;

a clinker cooler positioned to receive clinkers from said clinker outlet and including at least one air inlet into said clinker cooler;

an oxidant source in fluid communication with said at least one clinker cooler air inlet;

wherein said oxidant source comprises a non-pure-air oxidant selected from the group consisting of pure oxygen and oxygen-enriched air.

14. An improved kiln in accordance with claim 13, wherein said clinker cooler further comprises an air outlet in fluid communication with said kiln chamber.

15. An improved kiln in accordance with claim 13, further comprising a precalciner including a raw material inlet, a precalcined material outlet, and an air inlet, wherein said precalcined material outlet leads to said kiln chamber inlet, and wherein said precalciner air inlet is in fluid communication with and downstream of said clinker cooler.

16. An improved kiln in accordance with claim 13, further comprising an air blower having an inlet and an outlet, said air blower outlet in fluid communication and upstream of both said burner oxidant inlet and clinker cooler air inlet, said oxide orebigusra of said air blower inlet.

17. An improved kiln in accordance with claim 13, wherein said burner oxidant inlet and said clinker cooler air inlet are fluidly isolated upstream of said kiln chamber, and wherein said oxidant source comprises separate inlets to said burner oxidant inlet and said clinker cooler air inlet.

18. An improved kiln in accordance with claim 13, wherein said clinker cooler comprises a grate clinker cooler including a plurality of air blowers having inlets and which blow air into said grate clinker cooler, wherein said oxidant source is in fluid communication with at least one grate clinker cooler air blower and in separate fluid communication with said burner oxidant inlet.

19. An improved kiln in accordance with claim 18, wherein said grate clinker cooler includes a waste air outlet, and at least one air blower includes ail inlet which does not receive oxidant from said oxidant source.

20. An improved kiln in accordance with claim 13, wherein said kiln comprises a rotary kiln.

* * * * *

UNITED STATES PATENT AND TRADEMARK OFFICE

CERTIFICATE OF CORRECTION

PATENT NO. : 6,309,210 B1
DATED : October 30, 2001
INVENTOR(S) : Ovidiu Marin et al.

It is certified that error appears in the above-identified patent and that said Letters Patent is hereby corrected as shown below:

Claim 4,
Line 12, please replace the word "blowin" with the word -- blowing --.

Claim 9,
Line 42, please replace the word "bulner" with the word -- burner --.

Claim 16,
Line 32, please replace the phrase "both said burner oxidant inlet and clinker" with the phrase -- both said burner oxidant inlet and said clinker --.
Line 33, please replace the words "said oxide orebigusra of" with the words -- said oxidant source being upstream of --.

Claim 19,
Line 48, please replace the words "and at least one air blower includes ail inlet" with the words -- and at least one air blower includes an inlet --.

Signed and Sealed this

Ninth Day of April, 2002

*Attest:*

*Attesting Officer*

JAMES E. ROGAN
*Director of the United States Patent and Trademark Office*